United States Patent [19]

Gillis et al.

[11] 4,383,517

[45] * May 17, 1983

[54] COMBINATION COAL AND WOOD STOVE

[76] Inventors: Gordon A. Gillis, 400 E. Water St., Rockland, Mass. 02370; Richard Lucier, 610 N. Cary St., Brockton, Mass. 02402

[ * ] Notice: The portion of the term of this patent subsequent to Apr. 28, 1998, has been disclaimed.

[21] Appl. No.: 263,590

[22] Filed: May 14, 1981

[51] Int. Cl.[3] ..... F24C 1/14

[52] U.S. Cl. ..... 126/61; 126/200; 126/77; 126/163 R; 126/66

[58] Field of Search ..... 126/76, 163 R, 200, 126/192, 61, 66, 75, 77, 193, 136, 62, 121

[56] References Cited

U.S. PATENT DOCUMENTS

| | | | |
|---|---|---|---|
| 567,034 | 9/1896 | Loy | 126/61 |
| 1,576,603 | 3/1926 | Hamilton | 126/61 |
| 3,930,490 | 1/1976 | Lassy | 126/121 |
| 4,200,086 | 4/1980 | Kolb | 126/77 |
| 4,210,119 | 7/1980 | Kincaid | 126/61 |
| 4,248,203 | 2/1981 | Wilson | 126/77 |
| 4,263,885 | 4/1981 | Gillis et al. | 126/200 |

*Primary Examiner*—James C. Yeung
*Assistant Examiner*—G. Anderson
*Attorney, Agent, or Firm*—Wolf, Greenfield & Sacks

[57] ABSTRACT

The combination stove has a fire chamber that is partially cylindrical including a side loading door for loading wood or other combustible material such as coke or coal into the fire chamber. The front of the stove may be opened to enable viewing of the wood or coal burning in the stove by means of an arcuate sliding door that is operable to substantially totally close the chamber or open a section of the front thereof for viewing purposes. The sliding door is covered by a window construction including a tempered glass face. The stove is provided with an open base for supporting the chamber in a shroud covering the top and back of the chamber, preferably including blower means associated therewith. Particularly for wood combustion, the chamber is provided with a top draft extending longitudinally of the chamber and has supported therein a grate. For coal combustion, air input draft is coupled under the grate, preferably also including the capability of forced air draft using a portion of the forced air from the blower.

18 Claims, 6 Drawing Figures

4
86
11
88
41
138
94
136
42
60
5
66
68
50
97
51
81
79
10
90
20
64
48
92
104
105
58
108
126
18
57
74
62
56
124A
130A
128A
126A
112
110
106
130
128
124
101
12
102
16
14
13
15
4

11
52
50
53
57
79
51
81
58

34
37
38
32
32
26
33
30
22
24

COMBINATION COAL AND WOOD STOVE

BACKGROUND OF THE INVENTION

The present invention relates in general to heaters or stoves adapted for the burning of combustible materials such as wood, coal or coke. More particularly, the stove of the present invention is a combination stove that is adapted for the burning of either coal or wood. The stove of this invention is preferably also constructed in the form of a fireplace enabling a viewing of the combustion process whether coal, wood, or coke is being burned.

Some stove manufacturers have made claims that their stoves combust either coal or wood equally well. However, in accordance with the present invention the stove is particularly designed to operate at top efficiency whether burning wood, coal or any combination thereof. The construction of the present invention has taken advantage of the fact that wood and coal require different types of air induction. Generally, coal receives air from under the support grate for the coal and wood operates most efficiently under a down draft condition where air is received from above the fire chamber.

Accordingly, one object of the present invention is to provide a combination stove which operates to burn either wood, coal or coke effectively. In accordance with the invention this dual type of operation is facilitated by the simple operation of a baffle. In one mode of operation, an upper draft may be operated to control the down draft for wood burning. In another mode of operation, a ram air adjusting slide may be operated to control the lower draft for coal use. With the ram air induction, the blower associated with the stove forces a limited amount of air which is diverted into the firebox directly. The blower thus has the dual purpose of circulating air around the stove and away from the surface of the stove and also as a means for forcing a limited amount of air into the firebox.

Also, in accordance with the present invention it is possible to burn a combination of wood and coal. For example, with the stove already stoked with a deep cherry red bed of coal, wood may be loaded over the burning coal. The upper draft which provides down draft may then be opened with the lower draft closed so that there is no ram air input. When this switchover occurs, then flames will begin to shoot from the wood indicating that the stove is now down drafting properly for wood.

Another object of the present invention is to provide an improved combination coal and wood stove that is also provided with a front window through which the fire in the fire chamber may be viewed.

A further object of the present invention is to provide an improved combination stove having a fire chamber that is at least partially cylindrical providing an association with the front window, an arcuate sliding door that may be opened for viewing purposes of the burning fire.

Another object of the present invention is to provide an improved drafting system for a combination stove so as to enhance combustion and provide substantially complete burning of the combustible material.

A further object of the present invention is to provide a combination stove having an improved top shroud construction for directing heated air and also functioning as a top upon which items can be heated.

Another object of the present invention is to provide a combination wood and coal stove having an improved top shroud construction for directing heated air and also functioning as a top upon which items can be heated.

Another object of the present invention is to provide a combination wood and coal stove having an improved damper control at the outlet pipe from the stove.

Still a further object of the present invention is to provide an improved combination stove that also has a simple means of providing shaking of the grate for coal usage.

Another object of the present invention is to provide an improved combination stove having a shroud associated therewith with blower means in turn associated with the shroud for accelerating the heat recycling process so that the blown air is essentially cycled about a major circumference of the stove. In combination with this object, it is also advantageous to provide for ram air input to under the grate, particularly for drafting for coal or coke operation.

SUMMARY OF THE INVENTION

To accomplish the foregoing and other objects of this invention there is provided a stove or heater for the burning of wood and other combustible material such as coal or coke. The stove comprises means defining a fire chamber with support means under the fire chamber for support above a resting surface. The fire chamber is preferably constructed of a heavy gage metal, at least partially of cylindrical shape having means forming at least a front opening and a side opening of the firebox. A side door is provided adapted to be opened for feeding wood or other combustible material such as coal or coke into the fire chamber. The side door is of course closed, to substantially seal the side opening when the stove is in use. The side door is preferably hingedly supported from the stove. The stove that is described herein in addition to use as a stove for burning wood or coal, is also functional in a sense, as a fireplace and thus is provided with a front door and associated support means for permitting the front door to slide relative to the firebox to cover and uncover the front opening therein. Means are provided for controlling the position of the front door so as to open in one position permitting viewing through the front opening and to be closed in another position substantially sealing the door opening. In a preferred embodiment of the present invention the fire chamber is preferably formed at least partially in cylindrical shape and the front door comprises a cylindrical segment having a like radius to that of the firebox. The front door slides in channels connected to the firebox and in a preferred embodiment the door is maintained in an up position by a locking or holding means. The door may then be rotated downwardly to a closed position substantially sealing the front opening. The stove preferably also includes a front window housing covering the front opening and then including a heat-proof window supported in the housing spaced forwardly of the front opening. The control means for the front door is operable from the outside of the firebox and window housing.

In the construction described herein, there is provided a draft means disposed at a top portion of the fire chamber, particularly adapted to be controlled for woodburning operation, and a draft means controlled from outside of the fire chamber to permit air induction into the fire chamber below the fire chamber grate. This latter draft means includes a primary air draft and second draft which permits a portion of the air from the blower to be induced into a lower section of the fire chamber to enhance coal or coke burning. The draft system of this invention provides an extremely efficient burning of the combustible material and also permits a combination type of burning wherein wood can even be burned over a layer of burning coal or coke.

Within the fire chamber there is preferably provided a coal and/or wood basket having an open bottom adapted to receive a coal grate. There is also preferably provided in association with the stove a remote shaker handle operated from the side of the stove which permits limited shaking of the grate to dislodge the products of combustion.

Another feature of the present invention is the provision for a shroud means disposed over a portion of the outer surface of the fire chamber forming a duct for the passage of air to be warmed by passing adjacent the fire chamber wall. The shroud means preferably has a flat top forming a table-like surface upon which objects may be supported for heating thereof. The shroud also forms one or more restrictions to super heat the air as it passes therethrough. A blower associated with the circumferential duct arrangement brings cool air into a bottom section thereof and forces the air out through the top shroud. An external ram air slide rod may be used for controlling the air forced from the blower into the lower section of the fire chamber.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 3:
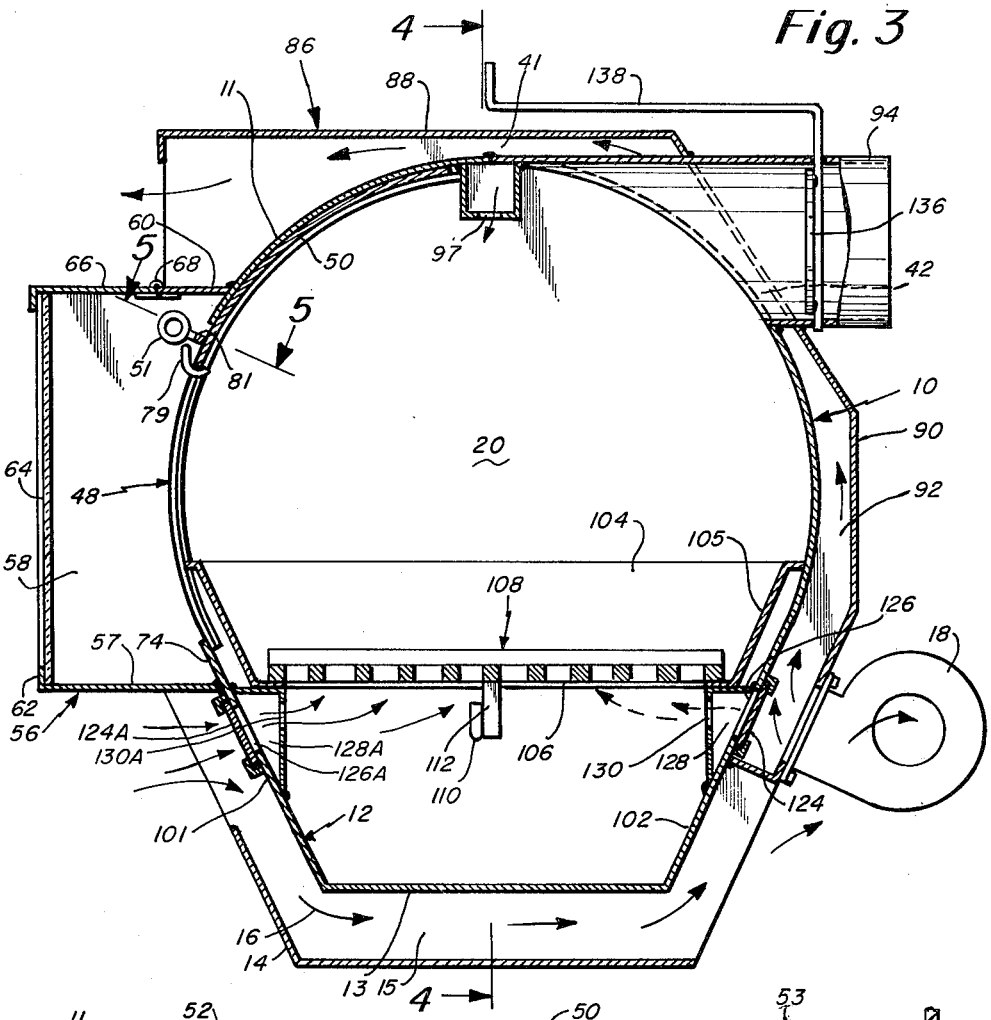
FIG. 3 is a cross-sectional view taken along line 3—3 of FIG. 1 showing further detail of the fire chamber construction and particularly depicting the paths of a circulation thereabout.

Referring now to the drawings, there is shown one embodiment of the present invention in the form of a combination wood and coal or coke stove. This stove has a firebox 10 which is preferably constructed of a high quality steel and includes a top cylindrical section 11 and a lower base section 12 having a flat bottom wall 13. There is also provided a base 14 which forms an opening or duct 15 for air circulating through the base 14; the air being drawn therethrough by means of a blower 18 discussed in further detail hereinafter. FIG. 3 clearly indicates by arrows 16 the air circulation including the input of cold air through the opening or duct work 15 with the blower 18 continuing the circulation of the air toward the upper section of the fire chamber defined by the firebox 10 particularly at its upper cylindrical section 11.

Figure 2:
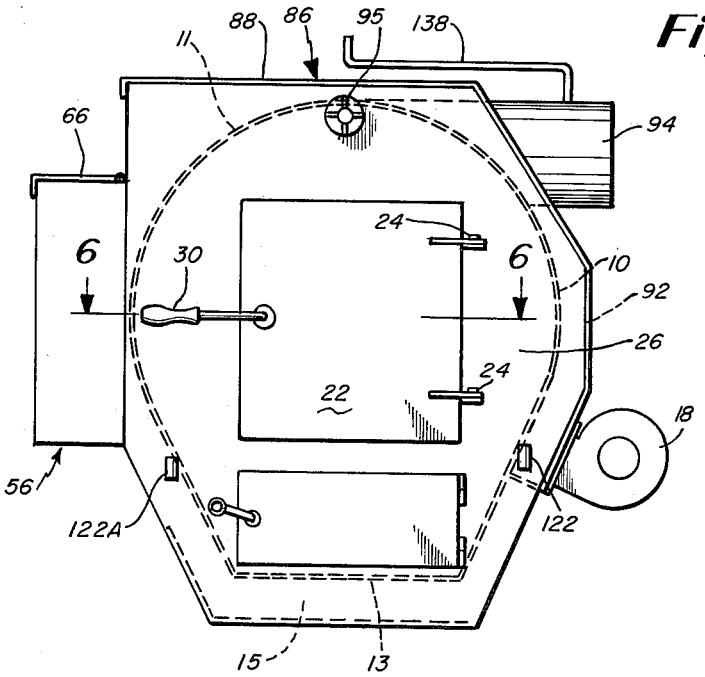
FIG. 2 is a side elevation view of the combination stove depicted in FIG. 1 showing the end including the side loading door and the ash drawer door.
Figure 6:
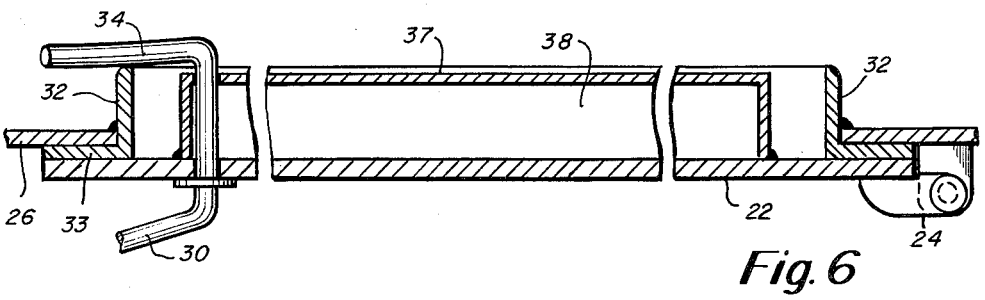
FIG. 6 is a cross-sectional view taken along line 6—6 of FIG. 2.
Figure 4:
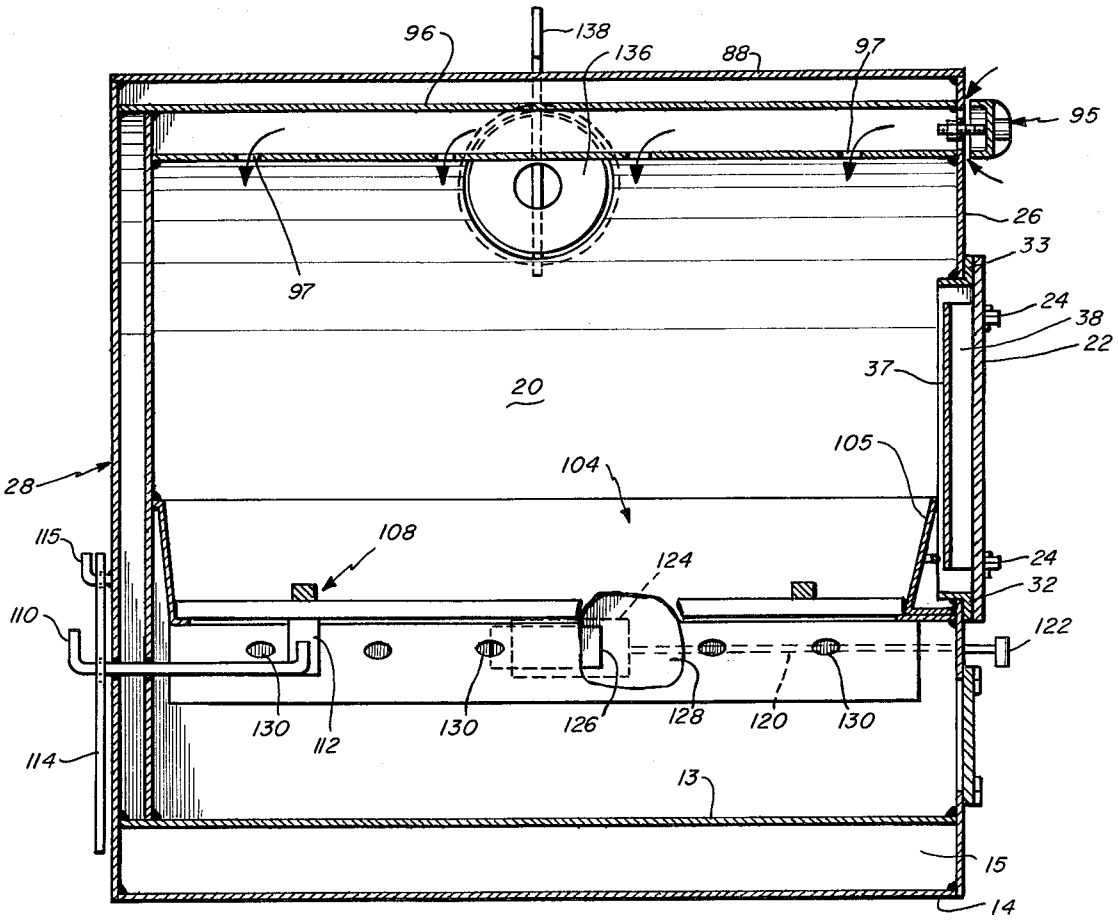
FIG. 4 is another cross-sectional view taken longitudinally of the combination stove along line 4—4 of FIG. 3 showing further details and air circulation paths.

The firebox 10 defines an inner predominantly cylindrical fire chamber 20 into which the wood, coal, coke or other combustible material may be loaded through the end or side door 22 secured by means of hinges 24 from the end wall 26 of the stove. The opposite end of the chamber is sealed totally by an opposite end wall 28 such as depicted in FIG. 4. This end wall construction is actually of double plate construction. The construction of the side door 22 is shown in FIGS. 2, 4 and 6.

As previously mentioned, the door 22 is hinged at hinges 24 to the wall 26 and is provided with a handle 30 for opening and closing the door. An L-shaped channel 32 extends about the periphery of the opening in the end wall 26. The channel 32 has a leg 33 which defines a surface against which the door 22 flushly closes such as in the position of FIG. 6. The handle 30 has a turned inner end 34 which is adapted to lock with the channel 32 also depicted in FIG. 6.

Figure 5:
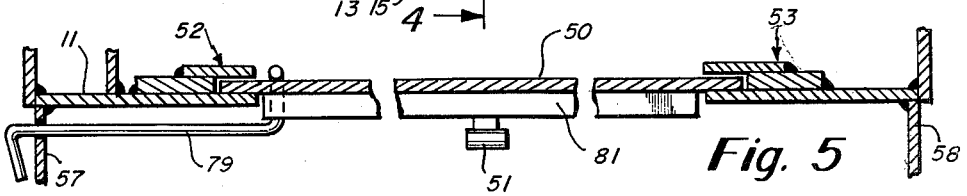
FIG. 5 is a cross-sectional view taken along line 5—5 of FIG. 3.

In addition to the opening provided for the side door 22, there is also provided a second front opening 48 which is of generally rectangular shape and which may be covered by the arcuate sliding door 50. Also, refer to FIG. 5. In FIGS. 3 and 5 the door 50 is shown in its fully open position. As depicted in FIG. 5, there are a pair of elongated members 52 and 53 which define a guide channel on opposite sides of the door 50 for guiding the door 50 in an arcuate manner to open and close the opening 48. The members 52 and 53 may each be formed of a pair of arcuately shaped plates, each fixed together and welded to the interior surface of the firebox 10. FIG. 5 depicts the welding. Each member 52, 53, is disposed adjacent the opening 48 and the members are spaced the appropriate distance to receive the arcuate door 50 leaving sufficient clearance to permit its easy sliding movement in the channel members.

In accordance with the construction described herein, there is also provided a window housing 56 which comprises a plurality of walls forming a box and extending about the opening 48. The housing 56 comprises a bottom wall 57, side walls 58 and 59, and a top wall 60. The side walls and the bottom wall terminate in a flange 62 extending about three sides of the housing and for partially supporting the tempered glass plate 64. On the inner side of the plate 64 there may also be provided ridges or the like extending from the walls for maintaining the plate in one predetermined vertical position. To provide access into the interior of the housing, there is provided a flap or flip-top access lid 66 hinged at 68 from the top wall 60, as depicted in FIG. 3. A knob (not shown) may be provided at the front of the flap or lid 66 to facilitate the lifting thereof about hinges 68 to provide access into the inside of the window housing 56 and directly into the fire chamber when the arcuate door 50 is open. When the lid 66 is raised to its open position, the panel 64 may easily be removed by lifting upwardly to remove it entirely from the window housing for the purpose of cleaning the panel or possibly for the replacement thereof.

Figure 1:
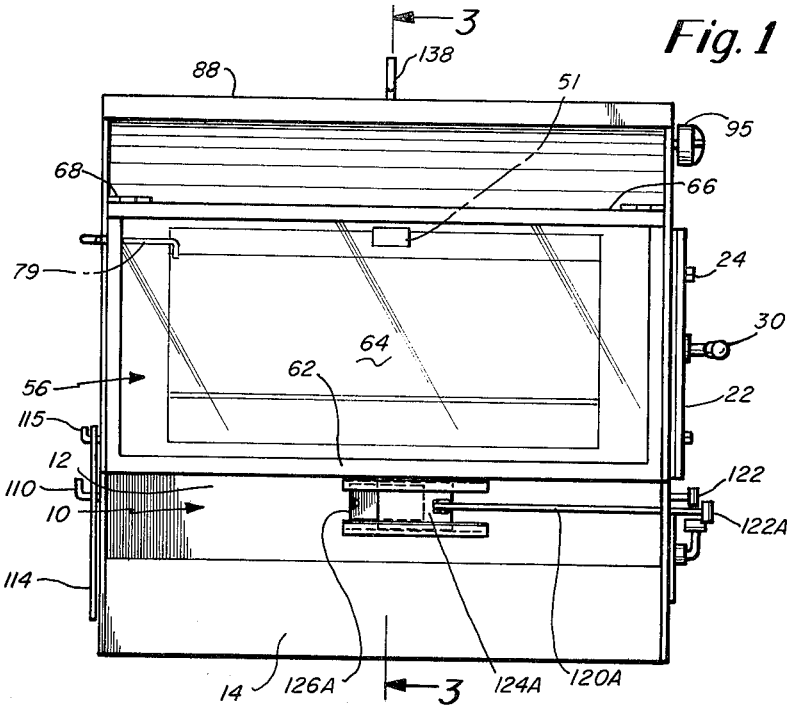
FIG. 1 is a front elevation of a preferred embodiment of a combination stove of this invention.

In FIG. 3 the arcuate door 50 is shown in its open position. The door 50 may be moved between open and closed positions grasping the handle 51 to move the door up or down. In the closed position, the handle 51 engages the lip 74 thus causing the door to bottom out. In the open position as depicted in FIG. 3, the locking member 79, also shown in FIG. 1, may be used. The member 79 slides inwardly and may engage under an edge of the door 50 such as under the lip 81 which may extend longitudinally across the entire face of the door.

In an alternate arrangement, the handle 51 may connect to an elongated rod extending horizontally across the entire width of the window housing. This rod connects to the handle 51 allows an arcuate path provided by an arcuate slot in the end walls 57 and 58. In addition, other types of means may be provided for locking the door 50 in an open position.

The stove that is depicted in the preferred embodiment also includes a shroud 86 having a flat top 88 upon which objects may rest, such as a pan for heating water or food. The shroud 86 also includes a slanted rear wall 90 and side walls forming an enclosed duct 92 through which the air passes as indicated by the arrows in FIG. 3. The blower 18 sucks the air from the lower duct 15 into the duct 92. The air as it passes through the passage 92 is heated from the fire chamber and exits in a forward direction of the stove. The shroud 86 is apertured to receive an outlet pipe 94 which is the exhaust from the chamber 20. The pipe 94 may be of conventional diameter for connecting to lengths of stove pipe which typically connect in turn to a chimney or the like. As depicted in FIG. 2, it is noted that at least two points 41 and 42, the passage 92 is quite restricted. In this way air is forced against the firebox chamber at these points to cause a super heating of the air or a charging of the air temperature to elevated temperatures. This provides for improved heating efficiency.

There is provided a top draft system, down draft operation, particularly when burning wood, including the secondary air spin draft 95. The draft member 95 may be rotated on a threaded support shaft and restricts flow in apertures associated with the member 95. Apertures 97, such as shown in FIGS. 3 and 4 provide the draft into the upper portion of the chamber 20. The apertures 97 are spaced along the tube 96. The draft member 95 leads to this elongated tube which is shown in FIG. 4 as closed at its opposite end. FIG. 4 has arrows indicating the manner of draft through this top secondary air spin draft system.

As indicated previously, the fire chamber 20 has a lower section that is non-cylindrical with a bottom wall 13 and tapered side walls 101 and 102. There is provided within the fire chamber, essentially demarcating the top and bottom sections, a coal and/or wood basket 104 that has slanted sides 105 and a bottom aperture 106 across which is supported the coal grate 108. There is provided a shaker mechanism including bar 110 secured at 112 to the grate and passing through an aperture in the rear double wall 28. The bar 110 has upwardly turned ends with the external end engaged in a passage in the handle 114. The top of the handle is pivoted at pivot member 115 secured to the walls 28. The handle 114 may be moved back and forth to shake the grate 108. This is particularly useful for coal operation.

Another important feature of the present invention is the ram air operation. FIG. 4 shows a long actuating rod 120 connected externally at an operating handle 122 and connected internally to a ram air adjustment slide 124. The adjustment slide is adapted to cover and uncover the ram air entry port 126. As depicted in FIG. 3, this port leads to a small chamber 128 having off of it, a series of ram air disbursement ports 130. FIG. 3 shows one of these ports while FIG. 4 shows a series of spacedly disposed ports 130. It is noted that the slide 124 essentially couples between passage 92 and the small chamber 128. Thus, the blower can be used on a dual function basis. The blower forces air around the stove to be heated but also a small amount of this forced air can be diverted into the firebox. This means that one can start or increase the heat of a coal fire quite rapidly.

Another feature of the present invention is the incorporation of a damper 136 and forwardly extending damper control rod 138 which provides for easy access at the front of the stove.

Another important feature of the present invention is the primary air slide draft operation. In this connection there is provided an actuating rod 120A connected externally at a operating handle 122A and connected internally to a primary air adjustment slide 124A. The adjustment slide is adapted to cover and uncover the primary air entry port 126A. This port leads to a small chamber 128A having coupled thereof, a series of disbursement ports 130A. FIG. 3 indicates by arrows the introduction of primary air through the front opening of the stove between section 12 and base 14.

One of the features of the present invention is the fact that this stove will burn coal, wood, coke, or other materials quite efficiently whether burned singly or in combination. The blower is preferably of relatively good size, such as a 465 CFM blower and has a capacity to circulate the air in an average home over the hot surfaces of the heating unit every 30 minutes. The shaker grate system is of extreme simplicity so that it can be operated quite easily. There may also be provided a removable ash pan resting upon the bottom wall 13 so that ashes can be removed quite easily. The stove has the capacity to make use of approximately 90% of the energy available in a cord of wood or a ton of coal. It burns wood or coal to a complete fine ash. When using wood, the top draft tube injects air at the top level of the stove while volatile gases released from the wood are ignited and utilized to generate a 30% to 40% of usable heat from the fuel. When burning coal, the top spin draft acts as a purging device to dissipate the gases coal burning emits. It is only necessary to open the draft about $\frac{1}{4}$ inch after the coal is fully ignited, after each stage of loading.

The shroud over the burning chamber is an outer skin which captures the radiating heat developed by the blower and make it possible to recover substantially high amount of the BTU's available.

The stove described herein is designed to allow very little creosote buildup, to burn slowly, efficiently, and to generate excellent heat output. This stove does not employ a conventional baffeling system because of the use of a special down draft tube construction which extends the full length of the unit and allows injection of oxygen at the top and rear exhaust areas of the fire chamber to properly initiate secondary combustion of volatile gases. Therefore, it forces the flames, gases or smoke in creosote to revolve within the dual cylindrical fire chamber developing extremely hot temperatures around the entire unit, not just on the top surfaces as in the case of many conventional units.

For usage with wood the fire is started with the drafts open including the flue damper and the access lid. When the fire chamber has the wood burning sufficiently, the access lid is closed, the top spin draft is opened and the slide draft is cut down. Also, the flue damper may be moved back towards its closed position. This action will slow the velocity of the flame path towards the flue area, therefore, developing a revolving action of the flame, gases, smoke and creosote forming acids within the fire chamber, thus creating increased BTU output, burning of volatile gases, more complete combustion, slower burning, and higher surface temperatures.

For coal burning procedures, this is initiated with a kindling wood fire. Then a sufficient amount of coal is added to cover the grate area. When this amount ignites, blue flame is coming through the coals, then additional amounts may be added in the same manner until the basket area is completely filled and burning intensely. It is desirable to keep the basket area filled to develop the maximum BTU output. In accordance with the present invention the coal receives proper and sufficient drafting from underneath the grate area. Also, the buildup of ash may be periodically shaken from the grate and the residue removed from the ash pan. This makes it possible for the air to be drawn in the primary bottom slide draft up under the entire grate area to facilitate proper burning. The bottom slide draft is preferably always in an open position one-half way or more to insure proper drafting for coal. But if the blower is on there will also be air forced through the primary slide draft opening, therefore, when the blower is operating you may want to reset the slide draft towards a more closed position. If the blower is off, then the slide may be opened more. Also, when burning coal, it is preferred to have the exhaust damper in an open position when initiating the burning process and it should not be totally closed so that coal gases have sufficient draft to escape to the chimney. It is also important when loading the stove through the load door that the top air spin draft and the primary slide draft be in a closed position and the flue damper opened fully thereby not causing smoke to puff back into the room.

What is claimed is:

1. A stove for burning combustible materials and comprising:

means defining a fire chamber including support means therefor and means forming at least a front opening and a side opening, side door means adapted to open for feeding wood or the like to the fire chamber or closed to substantially seal said side opening and including means supporting the side door from said fire chamber means adjacent said side opening, said front door means and associated support means therefor permitting said front door means to move relative to said fire chamber means to cover and uncover said front opening, means for controlling the position of said front door means to be open in one position permitting viewing through said front opening and closed in another position substantially sealing said front opening, said fire chamber being at least partially cylindrical, said front door means comprising an arcuate door and guide means for the door to permit the door to move relative to the fire chamber front opening to open and close the opening, said fire chamber also having at least primary tapered lower walls and a substantially flat bottom wall interconnecting the tapered walls, a basket means for the combustible material supported in said fire chamber over said tapered walls to be supported in a fixed position demarcating the fire chamber into upper and lower sections, said basket means having an open bottom, a grate in said basket means over the open bottom, handle means connected at one end to said grate adapted for manual movement of the grate, said bottom wall and associated tapered walls of the fire chamber forming an ash pit including an access door thereto, blower means, a first passage means extending about the exterior surface of the fire chamber with said blower means coupled therewith for circulating air about the fire chamber, and a second air passage means coupled from said first air passage means for coupling air directly into the fire chamber just under the basket means and grate, said second air passage means including a slide member that is manually adjustable to vary the volume of air coupled via the second air passage means into the lower section of the fire chamber, said second air passage means including aperture means extending side to side in said fire chamber substantially the length of the grate.

2. A stove as set forth in claim 1 including means supported from the front of said fire chamber over said front opening including a window forwardly of said front opening.

3. A stove as set forth in claim 2 wherein said window comprises at least in part a tempered glass panel.

4. A stove as set forth in claim 2 wherein said window housing also includes a top access means to said housing interior and said front door means.

5. A stove as set forth in claim 1 including first draft means associated with said side door means and second draft means disposed at a top portion of said fire chamber.

6. A stove as set forth in claim 5 wherein said draft means are both adjustable.

7. A stove as set forth in claim 1 including shroud means disposed over a portion of the outer surface of said fire chamber forming a duct for passage of air to be warmed by passing adjacent the fire chamber wall and forcing this air through a tight apex against the hot surface of the fire chamber at two strategic points thereby charging the air temperature.

8. A stove as set forth in claim 7 wherein said shroud means has a flat top forming a table-like surface upon which objects may be supported for heating thereof.

9. A stove as set forth in claim 7 wherein said shroud means extends about a top section and back section of the fire chamber.

10. A stove as set forth in claim 1 including an exhaust duct from the fire chamber and damper means for controlling the exhaust of gases from the fire chamber.

11. A stove as set forth in claim 1 wherein said first air passage means includes shroud means disposed over a portion of the outer surface of the fire chamber forming a duct for the passage of air to be warmed by passing adjacent the fire chamber wall, said passage having at least one reduced dimension restriction so as to force the circulated air against the hot surface of the fire chamber to thereby charge the air temperature.

12. A stove as set forth in claim 1 wherein said aperture means comprises a series of spaced apertures.

13. A stove as set forth in claim 1 wherein said blower means is disposed at the rear of the fire chamber with said slide member covering an entry port that leads to said aperture means.

14. A stove as set forth in claim 13 wherein said slide member is disposed adjacent said blower means whereby air is forced from said blower means across said first air passage means directly at said entry port to said aperture means.

15. A stove as set forth in claim 1 wherein said basket means at its front extends up to partially block said front opening.

16. A stove for burning combustible materials and comprising:

means defining a fire chamber including support means therefor and means forming at least a front opening and a side opening, side door means adapted to open for feeding wood or the like to the fire chamber or closed to substantially seal said side opening and including means supporting the side door from said fire chamber means adjacent said side opening, said front door means and associated support means therefor permitting said front door means to slide relative to said fire chamber means to cover and uncover said front opening, means for controlling the position of said front door means to be open in one position permitting viewing through said front opening and closed in another position substantially sealing said front opening, said fire chamber being at least partially cylindrical, said front door means comprising an arcuate door and guide means for the door to permit the door to slide relative to the fire chamber front opening to open and close the opening, blower means, and shroud means disposed over a portion of the outer surface of said fire chamber forming a duct for passage of air to be warmed by passing adjacent the fire chamber wall, said passage having at least one reduced dimension restriction so as to force the circulated air against the hot surface of the fire chamber to thereby charge the air temperature, said reduced dimension restriction being formed between the cylindrical fire chamber and a substantially flat wall of the shroud means.

17. A stove for burning combustible materials as defined in claim 16 including at least two said reduced dimension restrictions, one at the rear and one at the top of the fire chamber.

18. A stove for burning combustible materials as defined in claim 16 wherein said shroud means has a flat top wall and angled rear wall, both said walls spaced from the fire chamber and extending in a direction tangential to the fire chamber cylindrical portion.

* * * * *